US008182285B2

(12) United States Patent
Annequin et al.

(10) Patent No.: US 8,182,285 B2
(45) Date of Patent: May 22, 2012

(54) ELBOW COAXIAL ELECTRIC CONNECTOR AND METHOD TO ASSEMBLE SUCH A CONNECTOR

(75) Inventors: Sebastien Annequin, Voiron (FR); Christophe Chavanne, Voiron (FR)

(73) Assignee: Raydiall, Voiron (FR)

( * ) Notice: Subject to any disclaimer, the term of this patent is extended or adjusted under 35 U.S.C. 154(b) by 160 days.

(21) Appl. No.: 12/828,831

(22) Filed: Jul. 1, 2010

(65) Prior Publication Data

US 2011/0008999 A1 Jan. 13, 2011

(30) Foreign Application Priority Data

Jul. 7, 2009 (FR) ..... 09 54701

(51) Int. Cl.
*H01R 9/05* (2006.01)

(52) U.S. Cl. ..... 439/582

(58) Field of Classification Search ..... 439/582; 29/861

See application file for complete search history.

(56) References Cited

U.S. PATENT DOCUMENTS

| | | | | |
|---|---|---|---|---|
| 6,817,899 | B1 | 11/2004 | Zerebilov | |
| 6,860,761 | B2 * | 3/2005 | Lee et al. | 439/582 |
| 6,893,291 | B2 * | 5/2005 | Wendling et al. | 439/582 |
| 7,887,359 | B2 * | 2/2011 | Manser | 439/350 |
| 2004/0058582 | A1 | 3/2004 | Wendling et al. | |
| 2010/0317226 | A1 * | 12/2010 | Schmid et al. | 439/582 |
| 2011/0230092 | A1 * | 9/2011 | Maier et al. | 439/578 |

FOREIGN PATENT DOCUMENTS

| | | | |
|---|---|---|---|
| DE | 10 2004 041 809 | A1 | 4/2005 |
| DE | 20 2008 014 409 | U1 | 2/2009 |
| EP | 1 194 984 | B1 | 5/2003 |
| EP | 1 653 574 | A1 | 5/2006 |

OTHER PUBLICATIONS

Feb. 4, 2010 French Search Report issued in corresponding French Patent Application No. 09 54701 (with translation).

* cited by examiner

*Primary Examiner* — Neil Abrams
(74) *Attorney, Agent, or Firm* — Oliff & Berridge, PLC

(57) ABSTRACT

The present invention concerns a connection assembly comprising: an elbow coaxial electric connector (2) configured to be mounted on a coaxial cable, the connector comprising: a central contact (7) provided with at least one crimping portion (11) configured to be crimped with a central conductor of the coaxial cable, an insulating element (8) comprising a bearing portion (15) having an upper face (16) on which the crimping portion of the central contact is applied at least in part, and a body (9) receiving the insulating element. Also included is an elbow sleeve (5) comprising a first tubular portion extending along a first axis of the sleeve and configured to be received inside the casing, and a second portion (31) extending along a second axis of the sleeve and comprising a housing (38) configured to receive the coaxial connector mounted on the coaxial cable. A hollow casing (4) and a pivotal cover (6) are to be mounted on the elbow sleeve (5). The casing includes a latch tab (47).

19 Claims, 6 Drawing Sheets

Figure 1:
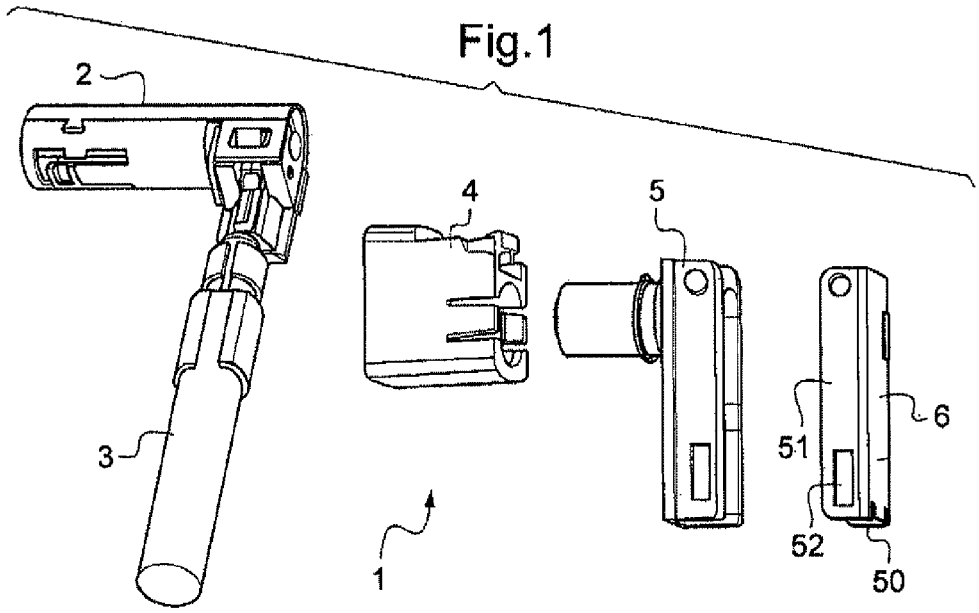

Fig.12
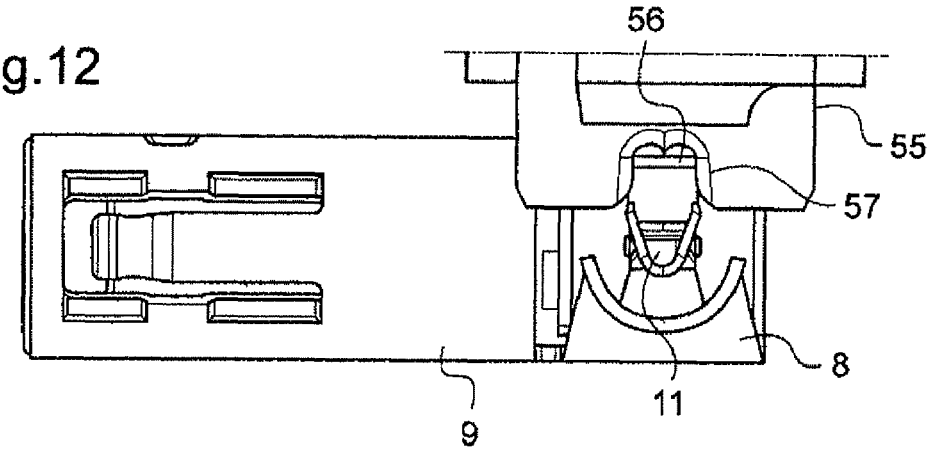
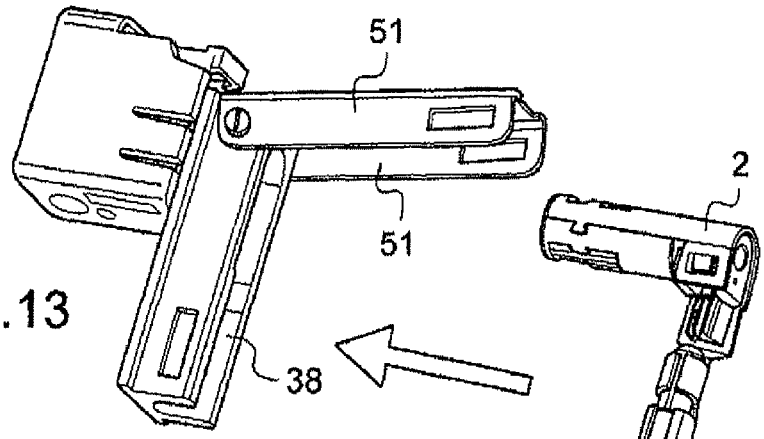
Fig.13
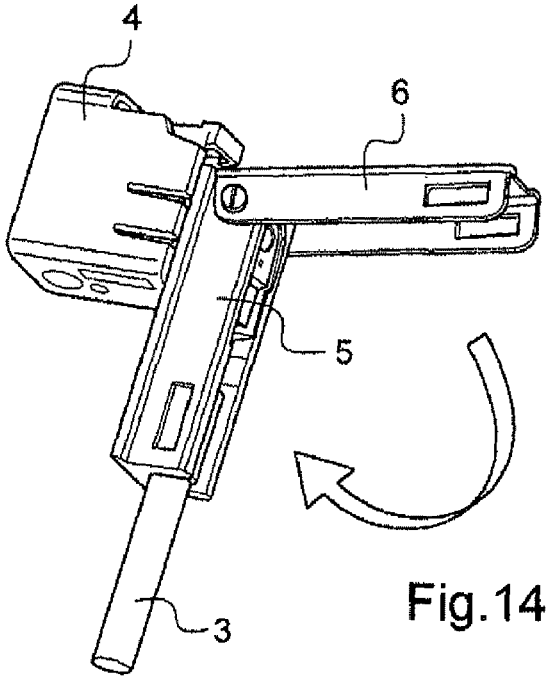
Fig.14

ELBOW COAXIAL ELECTRIC CONNECTOR AND METHOD TO ASSEMBLE SUCH A CONNECTOR

The subject of the present invention is a connection assembly comprising an elbow coaxial electric connector mounted on a coaxial cable and a method to assemble said assembly.

The invention applies more particularly to connection assemblies for the motor vehicle market, notably conforming to FAKRA (Automobile Expert Group) and USCAR standards.

Patent EP 1 653 574 to the applicant discloses a straight coaxial electric connector mounted on a coaxial cable by crimping the central contact of the connector onto the central conductor of the coaxial cable.

Applications DE 10 2004 041809 and DE 20 2008 014409 disclose elbow coaxial connectors comprising a straight central contact whose mounting on a coaxial cable requires an additional centring part and/or an additional fastening part. The coaxial connector disclosed by application DE 10 2004 041 809 is received inside the casing inside which it is able to rotate depending on whether a sliding lug is or is not in locked position. The coaxial connector disclosed by application DE 20 2008 014 409 is also received in a casing relative to which it can or cannot rotate depending on whether an additional connector is or is not coupled to the connector.

The solutions disclosed by applications DE 10 2004 041 809 and DE 20 2008 014 409 require a relatively high number of parts, and the assembling of an assembly comprising said connector and/or the coupling of said assembly with an additional assembly may be relatively time-consuming and costly to fabricate and requiring specific tooling.

There is a need to overcome all or part of the above disadvantages.

Exemplary embodiments of the invention provide a connection assembly comprising:

- an elbow coaxial electric connector for being mounted on a coaxial cable, the connector comprising:
  - a central contact provided with at least one crimping portion configured to be crimped with a central conductor of the coaxial cable,
  - an insulating element comprising a bearing portion having an upper face on which the crimping portion of the central contact is applied at least in part, and
  - a body receiving the insulating element,
- a casing hollowed on the inside, and
- an elbow sleeve comprising:
  - a first tubular portion extending along a first axis of the sleeve and configured to be received inside the casing, and
  - a second portion extending along a second axis of the sleeve and comprising a housing configured to receive the coaxial connector mounted on the coaxial cable.

The connection assembly of these exemplary embodiments of the invention comprises a reduced number of parts and may be relatively easy to assemble.

The central contact of the connector is advantageously elbowed and consists of a single part, contrary to the central contacts of the elbow connectors disclosed by applications DE 10 2004 041 809 and DE 20 2008 014 409

The body of the connector advantageously comprises at least one crimping portion to crimp at least one of a shielding braid and an outer insulating sheath of the coaxial cable.

The body of the connector may also comprise at least one crimping portion to crimp an inner insulating sheath of the coaxial cable.

These exemplary embodiments of the invention advantageously permit crimping of the coaxial cable onto the elbow connector with a relatively reduced number of operations. At least one of the crimping portion of the central contact of the connector, and a crimping portion of the body of the connector advantageously comprises a substantially U-shaped or V-shaped cross-section.

Contrary to the disclosure of patent EP 1 653 574, the coaxial connector may be devoid of any space arranged either side of the bearing portion of the insulating element, and extending at least partly underneath the crimping portion of the central contact. The absence of said space may allow the passing of a larger, hence more resistant, tool when crimping.

The insulating element of the connector is advantageously configured so that the central contact of the connector is fastened thereto by a bayonet connection, which may allow relatively easy, reliable mounting of the central contact in the insulating element of the coaxial connector.

The first axis and the second axis of the sleeve are not parallel, advantageously being perpendicular, forming an elbow.

The sleeve is advantageously made in a single piece, in metal for example.

The sleeve may be different from the body of the connector, the sleeve and the body being for example separate elements.

The first portion of the sleeve, on its outer lateral surface, advantageously comprises at least one groove extending over at least part of the periphery of said first portion of the sleeve, notably over its entire periphery.

The first portion of the sleeve, on its inner surface, advantageously comprises at least one slot extending parallel to the first axis of the sleeve and configured to cooperate with tabs arranged on the outer surface of the body of the coaxial connector, so as to allow the removable fixing of the coaxial connector inside the first portion of the sleeve.

The casing extends along a longitudinal axis and advantageously comprises at least one elastic tab configured to cooperate with the groove of the first portion of the sleeve, to hold the casing on the sleeve by press-fitting or snap-fitting. The elastic tab may also allow the transmission of mechanical forces between the casing and the sleeve when they are assembled.

The casing may be straight or not form on elbow. The bottom of the groove advantageously comprises a plurality of notches extending parallel to the first axis of the sleeve and which may form indexing means for the casing relative to the first portion of the sleeve. These notches are advantageously uniformly distributed around the periphery of the first portion of the sleeve.

The groove is advantageously laterally bordered by a collar comprising at least two portions separated by a cut-out. This collar may contribute towards the transmission of mechanical forces between the sleeve and the casing when they are assembled.

The casing, on its inner side surface, advantageously comprises at least one pin configured to slide in the cut-out of the collar and/or to be held by friction in a notch of the groove. The pin or pins may allow transmission of mechanical forces between the casing and the sleeve when they are assembled.

The pins are advantageously arranged at or in the vicinity of a longitudinal end of the casing.

The collar of the sleeve comprises three cut-outs for example and the inner surface of the casing has three pins. The cooperation between the pins and the cut-outs may allow the elastic tab(s) of the casing to be brought to a press-fit position in the groove of the first portion of the sleeve, and once this press-fit position has been reached, the casing may be moved in rotation about the first portion of sleeve in predefined angle positions corresponding to the positions of the notches of the groove. The casing may be held in the predefined angle positions by cooperation between the pins and the notches.

The casing may advantageously ensure a retaining function by means of the elastic tab(s) and an indexing function by means of the pins, without the addition of an additional part of elastic washer type or plastic part/tab frequently used in known solutions.

The casing advantageously comprises an area for coupling with an additional casing of another connection assembly, this area preferably being located on the upper face of the casing. This area advantageously comprises a hoop extending crosswise, notably perpendicular to the longitudinal axis of the casing, and a tab pivot-mounted on the casing about an axis perpendicular to the longitudinal axis of the casing, said tab advantageously being at least partly covered by the hoop. The hoop may comprise at least one cut-out arranged opposite a longitudinal end of said tab, which may ensure satisfactory amplitude of movement for pivoting of the lug, without it being necessary to increase the height of the hoop for this purpose. The invention may therefore provide for better compactness of the casing.

If the casing is not coupled with a casing of a connection assembly of complementary type, the longitudinal axis of the tab in the coupling area advantageously lies parallel to the longitudinal axis of the casing.

The hoop and tab may be made in a single piece with the remainder of the casing, or as a variant, they can be fitted thereto.

Advantageously the hoop only extends over one portion of the length of the casing, for example one portion of the length of the casing from a longitudinal end thereof, said longitudinal end coming into contact with the casing of a connection assembly of complementary type when these are coupled together.

The assembly advantageously comprises a locking cover configured to close the housing arranged in the second portion of the sleeve.

The locking cover is advantageously metallic. The configuration of the sleeve and cover allows high frequency leaks to be limited and reinforces the mechanical supporting of the connector in the sleeve. The sleeve which is in metal for example, advantageously surrounds the body of the coaxial connector, which may reduce risks of deterioration of the latter for example by bending of the body, whilst facilitating coupling with a connection assembly of complementary type, since the sleeve ensures a guiding function.

The locking cover is advantageously pivot-mounted on the sleeve.

The locking cover advantageously comprises an elastic tab configured to bear upon the body of the connector when the connector is received in the housing of the second portion of the sleeve, and to oppose the closing of said cover.

The bearing of the elastic tab of the locking cover on the body of the connector may set up electric continuity with the coaxial connector, ensuring earth contact. Also, since the elastic tab opposes the closing of the cover, the cover is advantageously held open for as long as a sufficient force is not exerted on the cover for closing thereof.

The sleeve and cover may be two separate parts, preferably in metal, joined by a pivoting hinge or, as a variant, they may be made in a single piece notably in metalized plastic comprising an elastic hinge.

Other exemplary embodiments of the invention provide a method to assemble a connection assembly comprising the following steps:

- providing a coaxial cable and an elbow coaxial electric connector configured to be mounted on said cable, the connector comprising:
  - a central contact provided with at least one crimping portion configured to be crimped with a central conductor of the coaxial cable,
  - an insulating element comprising a bearing portion having an upper face on which the crimping portion of the central contact is applied at least in part, and
  - a body receiving the insulating element,
- crimping the central conductor of the coaxial cable with the central contact of the coaxial cable using a crimping tool comprising a bearing surface on the crimping portion of the central contact,
- inserting the electric connector mounted on the coaxial cable in an elbow sleeve of which at least one portion is received inside a hollowed casing, and,
- closing a locking cover mounted on the sleeve so as to hold the electric connector in the sleeve.

The hollowed casing may be mounted by press-fitting onto a portion of the elbow sleeve, this casing being able to be moved in rotation about the sleeve.

Crimping of the central conductor of the coaxial cable with the central contact of the coaxial connector may be accompanied by simultaneous crimping of at least one of a shielding braid, an inner insulating sheath and an outer insulating sheath with corresponding crimping portions of the body of the coaxial connector.

The method of these exemplary embodiments of the invention may be particularly fast and easy to implement, thereby simplifying the assembly operations for a connection assembly comprising an elbow coaxial connector, and coupling operations to join one said assembly with an assembly of complementary type.

Figure 2:
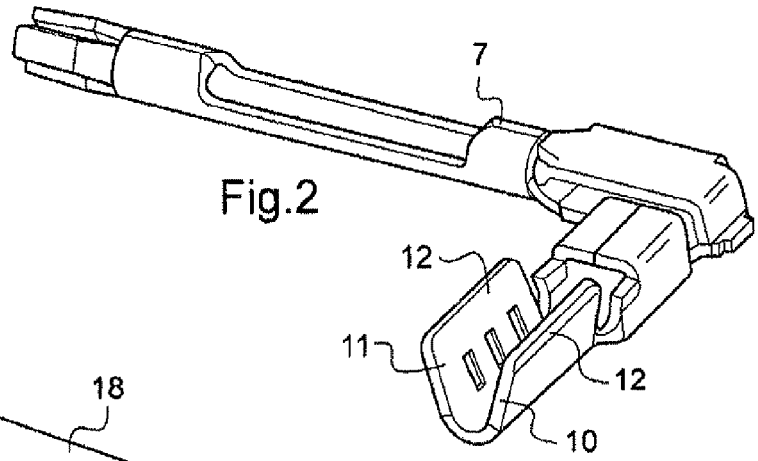
Figure 3:
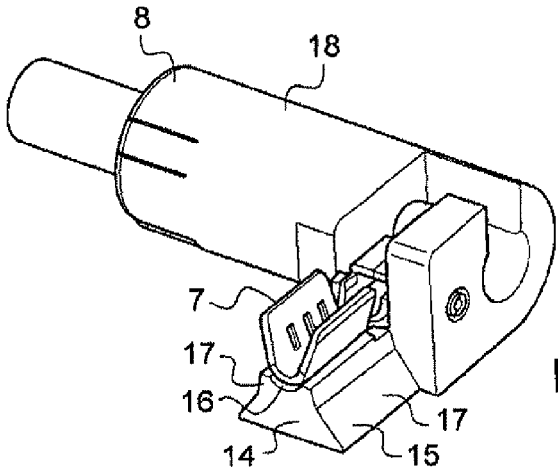
Figure 4:
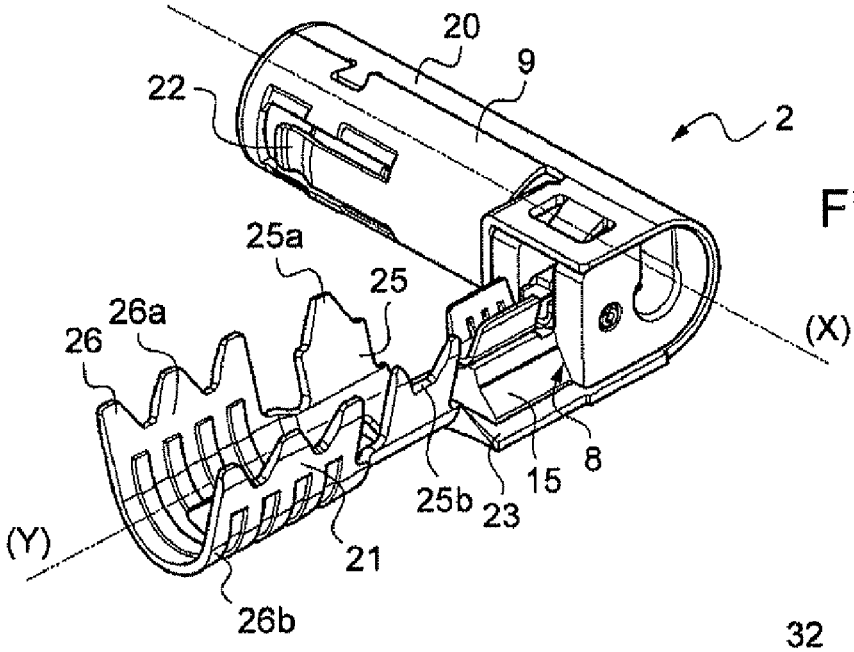
Figure 5:
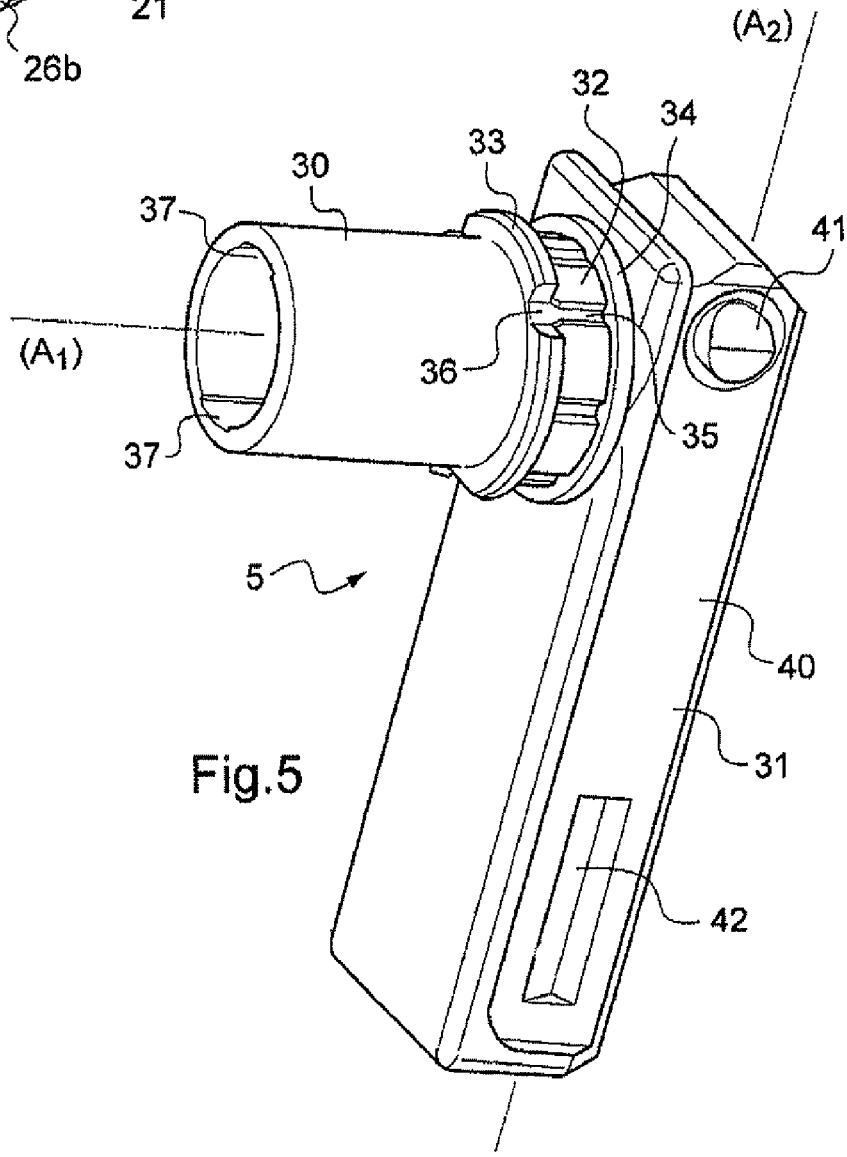
Figure 6:
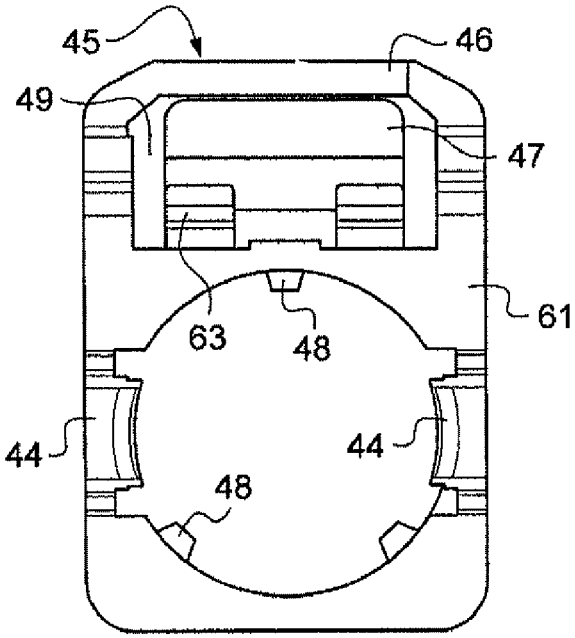
Figure 7:
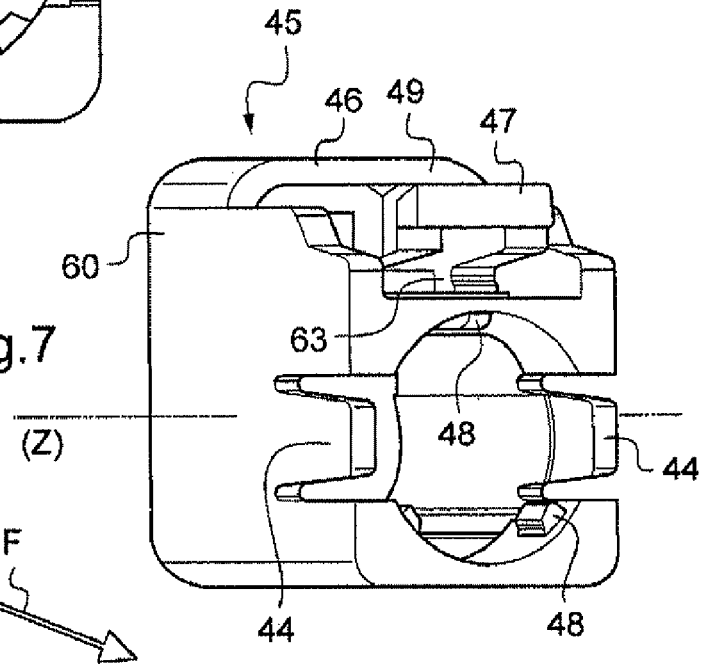
Figure 8:
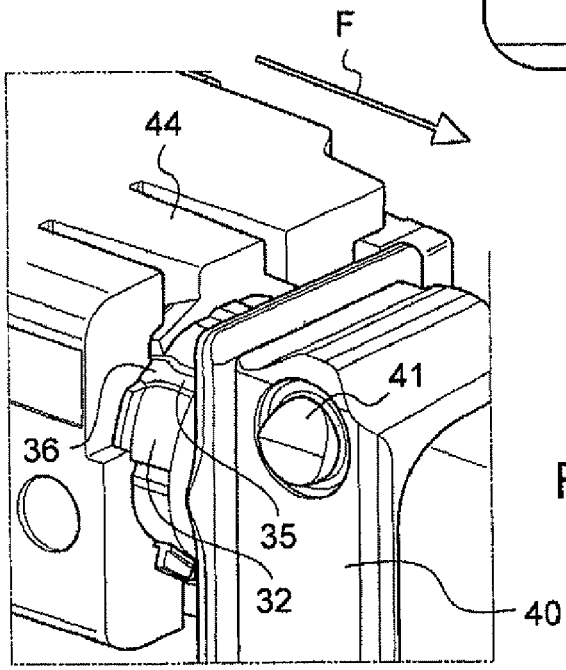
Figure 9:
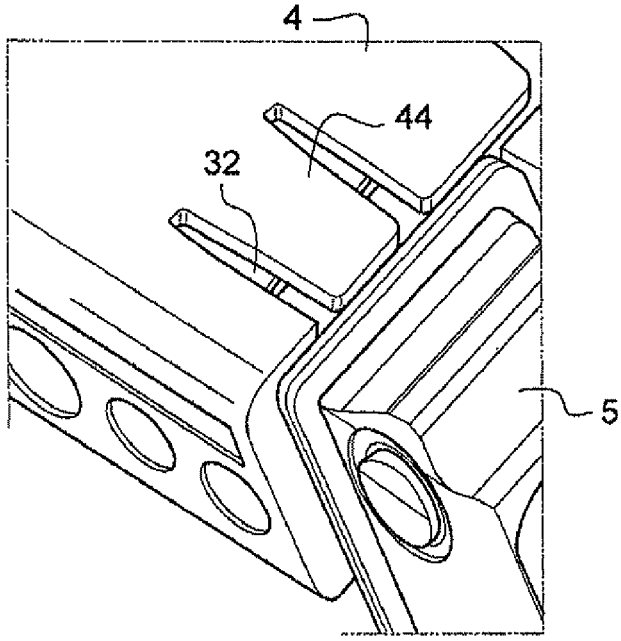
Figure 11:
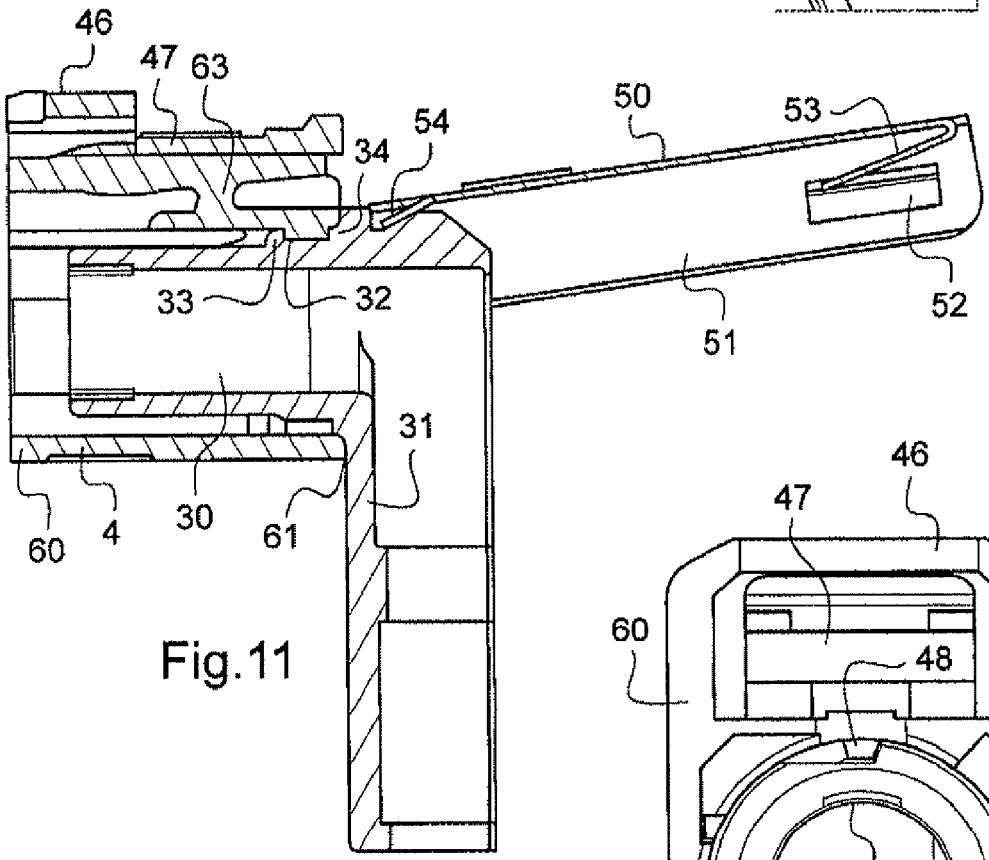
Figure 10:
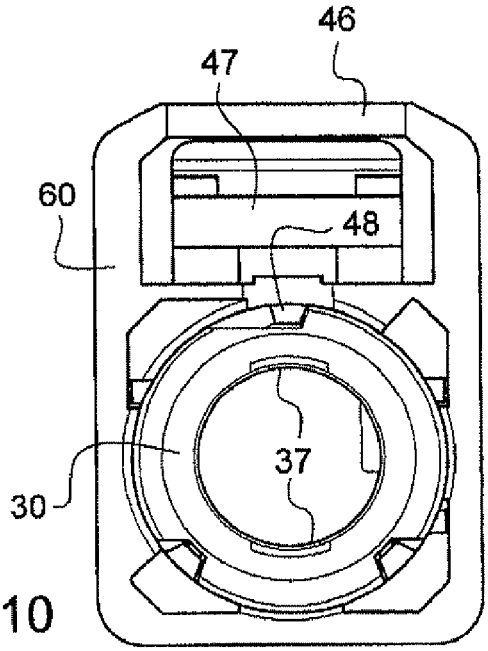
Figure 15:
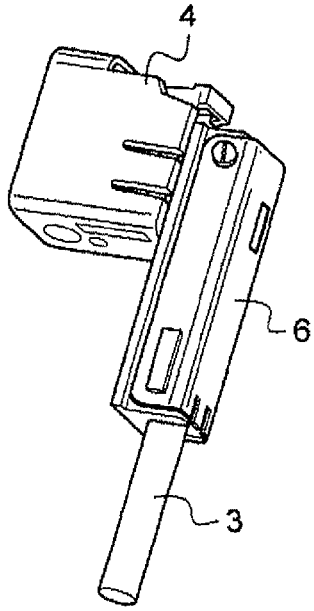
Figure 16:
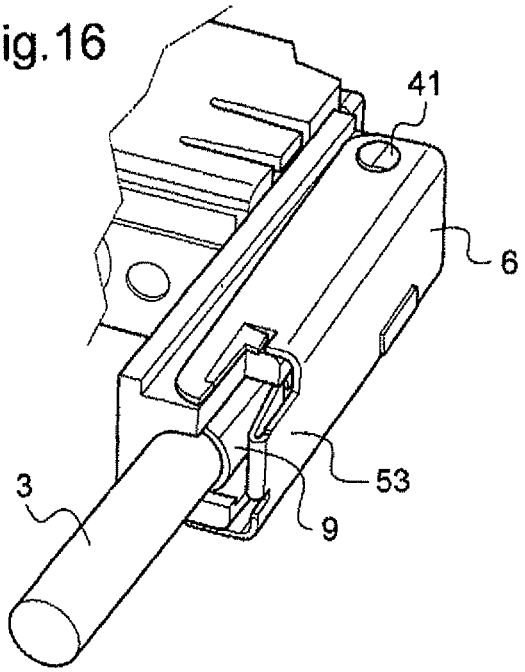
Figure 17:
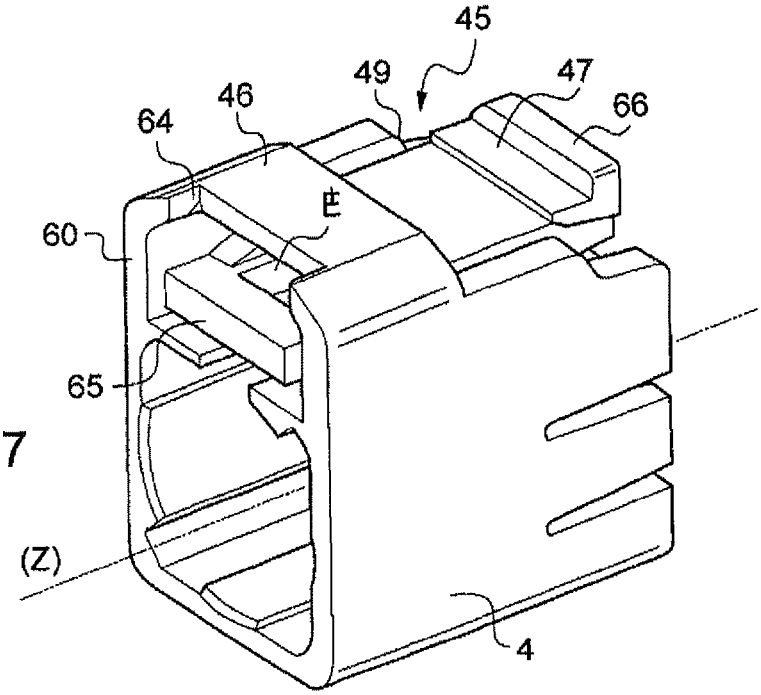

The invention will be better understood on reading the following description of non-limiting examples of embodiment, and on examining the appending drawings in which:

FIG. 1 is an exploded view of an assembly according to the invention,

FIGS. 2 and 3 show components of an elbow coaxial connector according to one example of embodiment of the invention, FIG. 4 illustrates the assembled elbow coaxial connector, FIG. 5 illustrates an elbow sleeve according to one example of embodiment of the invention, FIGS. 6 and 7 illustrate a casing according to one example of embodiment of the invention, FIGS. 8 and 9 illustrate different steps to mount the casing on the sleeve, FIG. 10 is a front view of the casing once it has been mounted on the sleeve, FIG. 11 is a cross-sectional view of the locking cover mounted on the sleeve, in open position, FIG. 12 shows a step in the mounting of the coaxial connector on a coaxial cable, FIGS. 13 to 16 illustrate steps to assemble an assembly according to the invention, and, FIG. 17 is a top view of the casing shown FIGS. 6 and 7.

FIG. 1 depicts a connection assembly globally referenced 1, according to one exemplary embodiments of the invention.

This assembly 1 in the described example comprises an elbow coaxial connector globally referenced 2 and mounted on a coaxial cable globally referenced 3, a casing globally referenced 4, an elbow sleeve globally referenced 5 and a locking cover globally referenced 6.

FIG. 4 illustrates the elbow coaxial connector 2.

This elbow connector 2 comprises a central contact 7, an insulating element 8 and a body 9.

The central contact 7, in the described example, is bent and made in a single piece using so-called <<cut-and-roll>> technology. The central contact 7 is in bronze for example coated with metal e.g. nickel, gold or tin depending on the area of the central contact concerned.

As may be seen, the central contact 7, at one end 10, comprises a crimping portion 11 comprising a U- or V-shaped cross-section with two opposite-facing branches 12 which may be folded down towards each other around the central conductor of the coaxial cable 3, as described below.

The crimping portion 11, as may be seen FIG. 3, rests on bearing portion 15 located at one end 14 of the insulating element 8. The insulating element 8 is elbowed and is made in a single piece for example, notably being made in high performance polymer material.

The bearing portion 15 of the insulating element 8 comprises an upper face 16 for example provided with a recess arranged to receive at least part of the crimping portion 11 of the central contact 7. The bearing portion 15 comprises two facing walls 17 for example which are directed downwardly and may be planar or may comprise two non-parallel portions.

The insulating element 8, at a cylindrical portion 18, comprises means for example allowing a bayonet connection to be established with the central contact 7.

The body 9 of the coaxial connector 2 in the described example is bent, comprising a first portion 20 extending along an axis (X) and innerly receiving the cylindrical portion 18 of the insulating element 8, and a second portion 21 extending along an axis (Y) and carrying the bearing portion 15 of the insulating element 8.

In the described example, the axes (X) and (Y) are perpendicular but the invention may be applied to any non-parallel arrangement of the axes (X) and (Y).

As illustrated FIG. 4, the first portion 20 of the body 9 may be tubular. This portion 20 may comprise at least one, notably two elastic tabs 22 extending along axis (X).

The second portion 21 of the body 9 may comprise a supporting part 23 receiving the bearing part 15 of the insulating element 8. This supporting part 23 comprises a cross-section relative to axis (Y) which forms a connecting region and which for example may be substantially triangular, but the invention is not limited to any particular shape of the cross-section of the supporting part 23. This supporting part 23 is non-cylindrical for example being devoid of edges defining a space with the side walls 17 of the bearing portion 15 such as described in patent EP 1 653 574.

The second portion 21, similar to the description in patent EP 1 653 574, may comprise two crimping portions 25 and 26 each having a cross-section relative to axis (Y) that is substantially U- or V-shaped.

The crimping portion 25, respectively 26, comprises a pair of fold-down branches 25*a* and 25*b*, respectively 26*a* and 26*b*, allowing crimping of the shielding braid and outer insulating sheath respectively of the coaxial cable 3, as will be seen below.

With reference to FIG. 5, a sleeve 5 will now be described according to one examplary embodiment of the invention.

In the described example, the sleeve 5 is elbowed comprising a first tubular portion 30 extending along a first axis of the sleeve ($A_1$) and a second portion 31 extending along a second axis of the sleeve ($A_2$), the first and second axis of the sleeve respectively lying parallel to axis (X) and axis (Y) when the coaxial connector 2 is received in the sleeve 5.

The sleeve 5 may be made in a single piece. As shown FIG. 5, the first portion 30, at the junction with the second portion 31, may comprise a groove 32 on its outer side surface. The groove 32 extends for example around the entire periphery of axis ($A_1$) and it is bordered laterally by two collars 33 and 34.

The collar 33 may, for example, comprise several discontinuous portions separated two by two by a cut-out 36. Each portion of the collar 33 may extend over a certain angular distance and the cut-outs 36 are distributed over the periphery of the first portion 30 of the sleeve 5.

The bottom of the groove 32 in the described example is provided with a plurality of notches 35 extending parallel to axis ($A_1$). These notches 35 are distributed uniformly for example in the circumferential direction, being separated in the described example by an angle of 45° measured from axis ($A_1$). Evidently, the invention is not limited this angle value.

As shown FIG. 5, the first portion 30 of the sleeve 5 on its inner surface comprises two slots 37 extending parallel to axis ($A_1$) and intended to cooperate with the elastic tabs 22 of the body 9 of the connector 2. The second portion 31, in the described example, is of globally parallelepiped shape.

A housing 38 extending parallel to axis ($A_2$), as illustrated FIG. 13, is arranged in the second portion 31. This housing may open towards the outside, the second portion 31 at the level of this housing 38 for example comprising a cross-section relative to axis ($A_2$) that is U-shaped for example. The second portion 31 in the described example further comprises two side faces 40 extending parallel to the second axis ($A_2$) and each carrying a chamfer 41 at one longitudinal end and a stepped portion 42 at their other longitudinal end whose role is described below.

With reference to FIGS. 6, 7 and 17 a casing 4 is now described according to one exemplary embodiment of the invention.

As shown in the figures, this casing 4 extends along a longitudinal axis (Z) which is parallel to axis (X) when the assembly 1 is assembled.

This casing 4 is made in polymer for example and is hollowed on the inside comprising a through passage along axis (Z).

The casing 4 comprises elastic tabs 44 for example arranged in its wall at one of its longitudinal ends 61. In the described example, the tabs 44 are two in number and lie diametrically opposite, but the invention is not limited to a number and to a precise position of the tabs 44.

As illustrated FIG. 17, the top of casing 4 may comprise an area 45 for coupling with a casing of a connection assembly of complementary type, this area 45 comprising a hoop 46 and a tab 47 pivot-mounted on the casing 4 about an axis perpendicular to axis (Z) of the casing via a hinge 63 and ensuring a locking function for the connection assembly 1 with a casing of a connection assembly of complementary type.

The hoop 46 in the described example extends perpendicular to axis (Z) and over a portion of the length of the casing 4 from one longitudinal end 60 thereof, said longitudinal end 60 coming into contact with the casing of a connection assembly of complementary type when coupled thereto.

As illustrated FIG. 17, the hoop 46 at end 60 comprises a cut-out 64 that is U-shaped for example. This cut-out 64 in the illustrated example lies opposite a longitudinal end 65 of the tab 47 and clears a space E to aid pivoting of the end 65 of the tab 47 in said space E when the tab 47 is actuated for locking/unlocking of the connection assembly 1.

As may be seen, the area 45 also comprises an open portion 49 on which the tab 47 is not covered by the hoop 46, aiding pivoting of the other longitudinal end 66 of the tab 47.

As illustrated FIGS. 6 and 7, the inner side surface of the casing 4 may comprise one or more pins 48 which may or may not be distributed uniformly around the periphery of the casing. The pins 48 are arranged for example substantially over one same periphery of the inner side surface of the casing 4, for example in the vicinity of or at the longitudinal end 61 of the casing 4 opposite the longitudinal end 60. The pins 48 and tabs 44 are located for example on one same periphery of the inner side surface of the casing 4, at the longitudinal end 61 in the illustrated example.

With reference to FIGS. 8 and 9 an example is described of the mounting of the casing 4 on the sleeve 5. As illustrated FIG. 8, the casing 4 is able to slide relative to the first portion 30 of the sleeve 5 under the effect of a force F. During this sliding movement, the pins 48 are able to enter through the cut-outs 36, having a cross dimension relative to axis (Z) that is smaller than that of the cut-outs 36 for example. Once the pins 48 have passed through the cut-outs 36, the tabs 44 of the casing 4 are able to press-fit into the groove 32 thereby ensuring the fixing of the casing 4 on the sleeve 5.

On completion of this sliding movement, the pins 48 are held by friction in notches 35 of the groove 32. A user is then able to move the casing 4 in rotation about the sleeve 5 bringing the pins 48 into other notches 35 of the groove 32.

The locking cover 6 is for example made in metal e.g. stainless steel or brass. The cover 6 in the described example is U-shaped comprising a back part 50 intended to close the housing 38 and two parallel sides 51 both perpendicular to the back part 50 and intended to cover the outside of surfaces 40 of the second portion 31 of the sleeve 5 when the cover is closed.

As may be seen FIG. 11, these faces 51 each comprise a stepped portion 52 intended to cooperate with a stepped portion 42 of the faces 40 of the second portion 31 of the sleeve 5 to ensure closing of the locking cover 6 on the sleeve 5.

In the described example, the cover 6 is pivot mounted on the sleeve 5, the faces 51 each comprising an opening to receive one of the chamfers 41.

The back part 50 of the locking cover 6 at one end may comprise a tab 54 illustrated FIG. 11, intended to cooperate with a relief of the sleeve 5 to hold the cover 6 in open position in a predefined position, and an elastic tab 53 located at the other end of the back part 50.

This elastic tab 53 is configured for example to exert a force opposing the closing of the locking cover 6 on the sleeve 5, the cover then not being closed for as long as a sufficient force is not exerted thereupon.

With reference to FIGS. 12 to 16 an example of the assembling of an assembly 1 of exemplary embodiments of the invention is now described.

As illustrated FIG. 12, the coaxial cable 3 may be crimped onto the coaxial connector 2 using a crimping tool 55 schematically illustrated in cross-section. This tool 55 comprises a cavity 56 for example defining a bearing surface 57 capable of being applied against the crimping portion 11 of the central contact 7. The bearing surface 57 may have a cross-section downwardly flaring outwards, at least in the vicinity of an opening through which the crimping portion 11 engages during crimping.

The bearing surface 57 of the tool 55 comprises for example two opposite-facing curved walls joining together at the bottom of the cavity 56. The form of the bearing surface 57 may be chosen substantially to follow the contour of at least part of the side walls 17 of the bearing portion 15 of the insulating element 8.

During crimping of the central conductor of the coaxial cable with the central contact 7, the tool 55 may be moved along an axis perpendicular to axis (Y), the branches 12 of the crimping part 11 being folded down gradually to avoid any outward buckling of these branches. The crimping portions 25 and 26 are similarly crimped, respectively on the shielding braid and the outer insulating sheath of the coaxial cable 2 using different parts of the tool. The connector 2 mounted on the coaxial cable 3 is then inserted in the sleeve 5 on which the casing 4 has previously been press-fitted, as illustrated FIG. 13.

The cover 6 may then be folded back so as to close the housing 38 to ensure the mechanical supporting of the connector mounted on the cable in the sleeve 5, and to ensure electrical continuity so that the assembly lies in the configuration shown FIG. 15.

As illustrated FIG. 16, the tab 53 of the cover 6 then comes to bear against the body 9 of the coaxial connector 2 and tends to holds the cover 6 in open position for as long as a sufficient force is not exerted thereupon.

The invention is not limited to the examples just described.

The invention claimed is:

1. Connection assembly, comprising:

an elbow coaxial electric connector configured to be mounted on a coaxial cable, the connector comprising:

a central contact provided with at least one crimping portion configured to be crimped with a central conductor of the coaxial cable, an insulating element comprising a bearing portion having an upper face on which the crimping portion of the central contact is applied at least in part, and, a body receiving the insulating element, a casing hollowed on the inside, and an elbow sleeve, comprising a first tubular portion extending along a first axis of the sleeve ($A_1$) and configured to be received inside the casing and a second portion extending along a second axis of the sleeve ($A_2$) and comprising a housing configured to receive the coaxial connector mounted on the coaxial cable.

2. Assembly according to claim 1, the central contact of the coaxial connector being elbowed.

3. Assembly according to claim 1, the body of the connector comprising at least one crimping portion to crimp at least one of a shielding braid and an outer insulating sheath of the coaxial cable.

4. Assembly according to claim 1, at least one of the crimping portion of the central contact of the connector and a crimping portion of the body of the connector comprising a substantially U- or V-shaped cross section.

5. Assembly according to claim 1, the insulating element of the connector being configured so that the central contact of the connector is fixed to the latter by a bayonet connection.

6. Assembly according to claim 1, the first portion of the sleeve on its outer side surface comprising a groove extending over at least part of the periphery of said first portion.

7. Assembly according to claim 6, the casing extending along a longitudinal axis (Z) and comprising at least one elastic tab configured to cooperate with the groove to hold the casing on the sleeve by press-fitting.

8. Assembly according to claim 6, the bottom of the groove comprising a plurality of notches extending parallel to the first axis ($A_1$) of the sleeve.

9. Assembly according to claim 6, the groove being laterally bordered by a collar comprising at least two portions separated by a cut-out.

10. Assembly according to claim 8, the casing on its inner side surface comprising at least one pin configured to at least one of slide in the cut-out of the collar and be held by friction in a notch of the groove.

11. Assembly to according to claim 7, the casing comprising an area for coupling with a casing of complementary type of another connection assembly, said area comprising a hoop extending crosswise relative to the longitudinal axis (Z) of the casing and a tab pivot mounted on the casing about an axis perpendicular to the longitudinal axis (Z) of the casing, the hoop comprising at least one cut-out arranged facing a longitudinal end of said tab.

12. Assembly according to claim 1, comprising a locking cover configured to close the housing arranged in the second portion of the sleeve.

13. Assembly according to claim 12, the cover being pivot mounted on the sleeve.

14. Assembly according to claim 12, the cover comprising an elastic tab configured to bear upon the body of the connector when the connector is received in the housing of the second portion of the sleeve, and to oppose the closing of said cover.

15. Assembly according to claim 12, the sleeve and the cover being two separate pieces.

16. Assembly according to claim 12, the sleeve and the cover being made in a single piece.

17. Method to assemble a connection assembly comprising the following steps:

providing a coaxial cable and an elbow coaxial electric connector configured to be mounted on said cable, the connector comprising:

a central contact provided with at least one crimping portion configured to be crimped with a central conductor of the coaxial cable, an insulating element comprising a bearing portion having an upper face on which the crimping portion of the central contact is applied at least in part, and, a body receiving the insulating element, crimping the central conductor of the coaxial cable with the central contact of the connector using a crimping tool comprising a bearing surface on the crimping portion of the central contact, inserting the electric connector mounted on the coaxial cable in an elbowed sleeve of which at least one portion is received inside a hollowed casing and, closing a locking cover mounted on the sleeve, so as to hold the electric connector in the sleeve.

18. Method according to claim 17, the hollowed casing being press-fit mounted on a portion of the elbowed sleeve.

19. Method according to claim 17, crimping of the central conductor of the coaxial cable with the central contact of the coaxial connector being accompanied by simultaneous crimping of at least one of a shielding braid, an inner and an outer insulating sheath with corresponding crimping portions of the body of the coaxial connector.

* * * * *